United States Patent [19]

Smith

[11] 4,067,132

[45] Jan. 10, 1978

[54] SAFETY DEVICE FOR PREVENTING THE UNAUTHORIZED FIRING OF A WEAPON

[76] Inventor: Joseph E. Smith, 170 Locksunart, Apartment 23, Sunnyvale, Calif. 94087

[21] Appl. No.: 670,937

[22] Filed: Mar. 26, 1976

Related U.S. Application Data

[63] Continuation-in-part of Ser. No. 530,891, Dec. 9, 1974, Pat. No. 3,978,604.

[51] Int. Cl.[2] ..... F41C 17/08

[52] U.S. Cl. ..... 42/66; 42/1 LP; 42/1 MH; 42/70 F

[58] Field of Search ..... 42/1 Y, 70 E, 1 MH, 42/1 LP, 66, 70 F

[56] References Cited

U.S. PATENT DOCUMENTS

| | | | |
|---|---|---|---|
| 2,401,482 | 6/1946 | Hendey | 42/70 E |
| 2,945,316 | 7/1960 | Mulno | 42/66 |
| 2,979,845 | 4/1961 | Christiansen, Jr. | 42/70 E |
| 3,422,559 | 1/1969 | Woloch | 42/66 |
| 3,626,622 | 12/1971 | Uberti | 42/66 |
| 3,673,725 | 7/1972 | Cravener | 42/1 LP |
| 3,978,604 | 9/1976 | Smith | 42/70 E |

*Primary Examiner*—Charles T. Jordan
*Attorney, Agent, or Firm*—Richard Alan Brown

[57] ABSTRACT

Trigger safety device for trigger-actuated devices is provided having a pivotally mounted magnetically responsive bar positioned on the inside of the handle or on the rear of the trigger. When the bar is oriented centrally, sufficient movement of the trigger is inhibited to prevent actuation. The bar may be mounted in a non-magnetizable casing. The user of the device, by wearing a magnetic ring, displaces the bar from its central orientation and allows for sufficient movement of the trigger for actuation.

13 Claims, 10 Drawing Figures

FIG _ 1
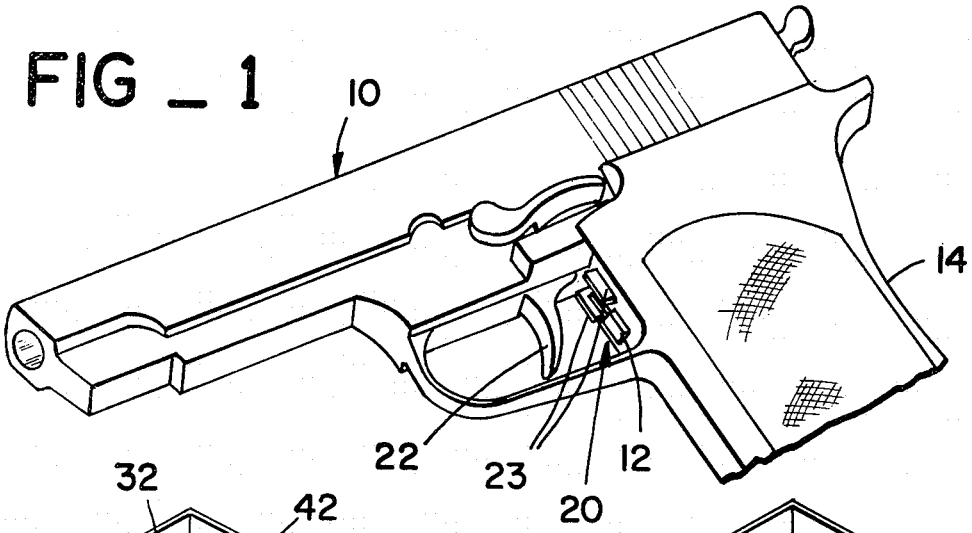
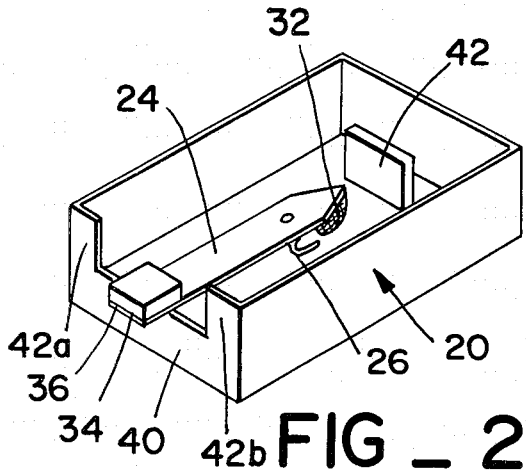
FIG _ 2
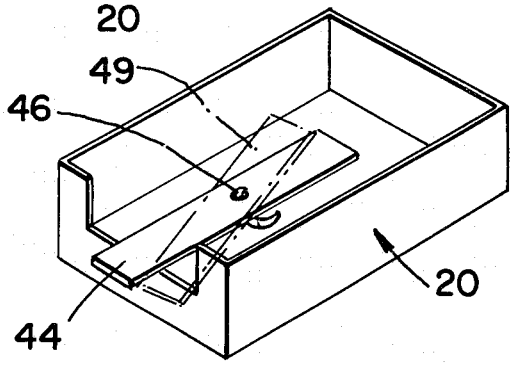
FIG _ 5
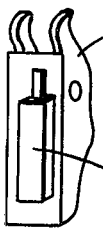
FIG _ 3
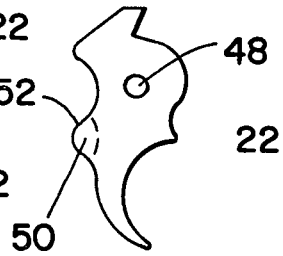
FIG _ 4
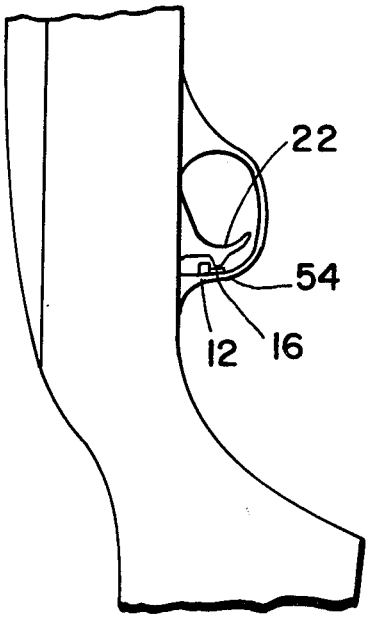
FIG _ 8
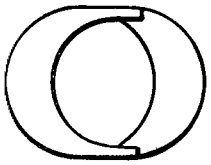
FIG _ 6
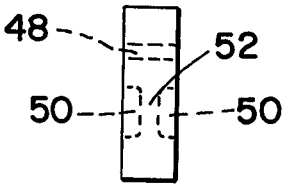
FIG _ 7

SAFETY DEVICE FOR PREVENTING THE UNAUTHORIZED FIRING OF A WEAPON

BACKGROUND OF THE INVENTION

This is a continuation-in-part of the Application Ser. No. 530,891, filed Dec. 9, 1974 now U.S. Pat. No. 3,978,604.

FIELD OF THE INVENTION

There is a well-recognized need to prevent, for example the undesired firing of a firearm. Many accidental shootings occur when the weapon is fired despite the fact that the holder does not pull the trigger. Also, of concern with law enforcement officers, is the loss of their weapon during an investigation or altercation, when the law enforcement officer is disarmed and threatened with his own weapon.

A simple device is desirable which would prevent other than the owner from firing a firearm or otherwise operating a trigger-actuated device. Also, it would be useful to have a protective device which would prevent accidental firing of a firearm or any unauthorized use of a trigger-actuated device.

BRIEF DESCRIPTION OF THE PRIOR ART

A number of sophisticated protective devices have been provided for firearms or trigger-actuated devices. The following U.S. patents describe such devices: U.S. Pat. Nos. 2,195,693; 2,401,482; 439,055; 2,979,845; and 3,031,787. Also of interest are U.S. Pat. Nos. 3,571,544; 3,944,762; 3,801,767; 2,548,581; and 3,493,902, which generally disclose magnetic safety or switching mechanisms.

SUMMARY OF THE INVENTION

A simple safety mechanism for trigger-actuated devices is provided employing a magnetically responsive bar pivotally mounted adjacent the back of the trigger or in the housing of the device. Such devices may comprise, for example, a gun, a revolver, a semi-automatic handgun, shotgun or rifle. The bar is preferably balanced about the pivot point, so as to maintain a neutral position, whereby it inhibits the displacement of a moveable part of the device such as, for example, the hammer of a weapon a sufficient distance for firing. It is noted, however, that the bar need not necessarily be balanced about the pivot point since the bar may be held in any position by a biasing means so as to inhibit displacement of the moveable part. In a specific embodiment, a weak magnet forming the biasing means is positioned to aid a non-magnetic bar to maintain the inhibiting position, while a magnetic bar may be centered by the steel trigger or steel in the device housing. The user of the device wears a magnetic ring, which either attracts or repels the bar and moves it out of confrontation, so as to allow for the actuation of the trigger actuated device.

BRIEF DESCRIPTION OF THE DRAWINGS

FIG. 1 is a fragmentary perspective view of an automatic pistol with the safety device attached to the handle;

FIG. 2 is a perspective view of one embodiment of the safety device;

FIG. 3 is a perspective view of the trigger with the safety device mounted on its rear;

FIG. 4 is a side elevation view of a modified trigger;

FIG. 5 is a perspective view of an alternate embodiment of the safety device;

FIG. 6 is a front elevation view of a magnetic ring;

FIG. 7 is a rear elevation view of the trigger;

FIG. 8 is a side elevation view of a rifle with the safety device attached to the trigger protector;

DESCRIPTION OF THE SPECIFIC EMBODIMENTS

Figure 9:
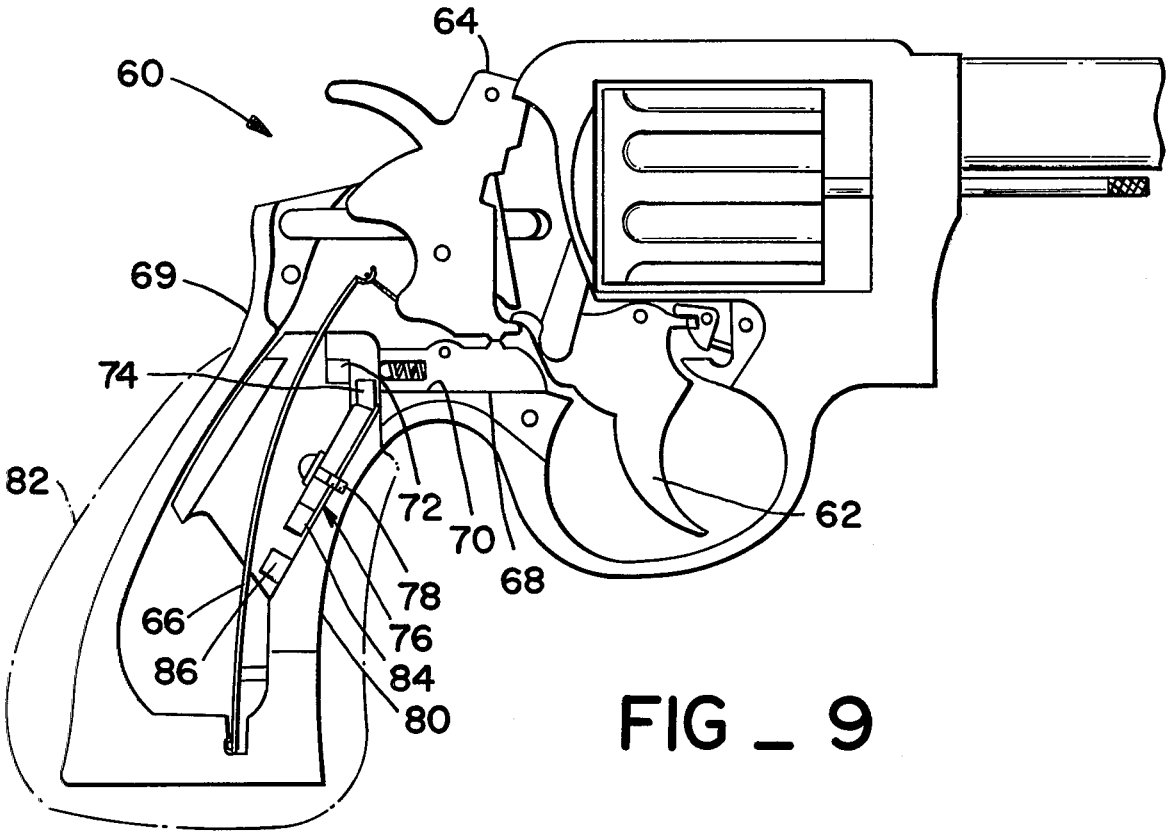
FIG. 9 is a side elevation view of an embodiment of a revolver incorporating the safety device.

A simple efficient device is provided as a safety mechanism to prevent accidental firing of a firearm, or any unauthorized use of a trigger-actuated device. The subject device is operable by both left and righthanded users and is not readily interfered with by an unauthorized user. The device is relatively foolproof in requiring the user to have a magnet before the trigger can be moved to actuate the firing mechanism. In one embodiment the subject device fits into the space or well between the trigger and the handle or butt of firearms. Furthermore, the space is kept sufficiently small, so that the device cannot be easily manually manipulated. In other embodiments the subject device is totally enclosed by the handle grip. In addition, the subject device is reliable and remains operative during normal cleaning operations for pistols, such as ultrasonic cleaning.

The subject device comprises a pivotally mounted magnetic pin or bar, which may be balanced about the pivot. The bar is positioned either on the back of the trigger or in the handle or butt near the roof of the well defined by the trigger, stock and handle, so as to be directed toward the confronting surface. Stops are provided to prevent the bar from swinging too far from the midpoint or desired plane. The bar is retained substantially in a plane through the long axis of the barrel dividing the firearm in half.

Depending upon the material of the firearm to which the device is attached, the swivel bar will be a magnetic or a non-magnetic material. In embodiments where the bar is disposed to block trigger movement, the firearm handle or butt (hereinafter "handle" will intend handle of a pistol and stock of the rifle behind the trigger) would preferably be of a non-magnetic material and the trigger would be magnetically attractable. In this manner, a magnetic bar would be centered by its attraction to the trigger and held in that position until attracted or repulsed by a magnet. Where the bar is mounted onto a magnetically attractable material, the bar will be a non-magnetic material. A weak magnet may be employed adjacent the end opposite the confronting end of the bar, so as to align the bar in the central position for blocking the trigger. Conveniently, the bar may be mounted in a nonferruginous housing, e.g. metal or plastic, which is mounted on or in the handle or butt of the firearm, so that only a small portion of the bar extends from the housing.

The swivel bar may similarly be mounted within the handle or butt of the firearm in a neutral position blocking translation of a slide or a rod, coupled to either the trigger or to the hammer, thereby inhibiting the hammer from releasing to strike a charge or cartridge disposed in the chamber of the weapon. In one embodiment, movement of the trigger and thus of the hammer may be inhibited, in a further embodiment, the hammer alone may be inhibited from striking the firing pin.

For further understanding of the invention, the figures will now be considered.

In FIG. 1 a pistol 10 is shown with the safety device 12 mounted on the pistol handle 14. The swivel bar 16 extends from the nonferruginous housing 20 in confronting relationship with trigger 22. Protective walls 23 may optionally be provided on the sides of the housing 20 adjacent the swivel bar 16.

Two different embodiments of the safety device are depicted in FIGS. 2 and 5. In FIG. 2, a non-magnetic bar 24 is pivotally mounted on post 26, which is affixed to the housing floor. The bar 24 has weight 32, ferruginous and pointed at one end, which serves to balance the bar and keep the bar in the center position of the rear magnet 42. At the opposite end 34 of the bar 24 is a ferruginous block 36, which is attracted to magnetic material, respectively. The front wall 40 of the housing 20 has an aperture with side walls **42*a* and 42*b*, which serve as stops to prevent bar 24 from moving too far to either side. In this way, the bar 24 remains centered in confronting relationship with the trigger 22 (FIG. 1**).

The housing 20 is conveniently formed of metal or plastic, and preferably formed of a non-magnetically attractable material. As a result, the housing does not interfere with the movement of the bar 24 or create any drag on the bar 24.

In FIG. 5, an alternate emnbodiment has housing 20 and magnetic bar 44. Magnetic bar 44 is pivotally mounted on post 46 at its center of gravity, so as to be balanced about the pivot point. The bar is shown in the safety position. The bar 49 in phantom is shown in the firing or safety off position.

When the safety device 12 is mounted on the handle, the trigger 22, as depicted in FIGS. 4 and 7, is notched on each side to provide indents 50 and leave a center projection 52, which is in confronting relationship with the swivel bar 16. The portion of the trigger 22, which is notched, is a projection of the trigger behind and below the pivot pin sleeve 48.

In FIG. 3, the safety device 12 is mounted onto trigger 22. When mounted onto trigger 22, the swivel bar 16 will confront the handle. It is pointed out that swivel bar 16 corresponds to the non-magnetic bar 24 as shown in FIG. 2, and the magnetic bar 44 shown in FIG. 5. Portions of the handle may be formed of non-magnetic material such as aluminum so as not to interfere with the magnetic forces on the swivel bar 16. Furthermore, portions of the handle may be notched, and may be comparable to the notching of the trigger, to allow for the retraction of the trigger without the swivel bar encountering the handle.

In FIG. 6 is depicted a magnetic ring which may be worn on the trigger finger of the user of the firearms wherein the safety device is provided adjacent the trigger. In embodiments explained hereinafter the ring may be worn on for example the ring finger. When the trigger finger is placed on the trigger, the magnetic ring attracts or repels the swivel bar 16 moving it out of confronting relationship with the projection present on the handle or trigger. The trigger is then free to be retracted for firing.

The size of the well between the trigger and handle will vary depending on the nature of the firearm. In some instances, it will be necessary or desirable to hollow out a portion of the handle for insertion of the safety device. The amount of the upper portion of the handle that must be removed can be readily determined in accordance with the dimensions of the various parts involved. The particular angle at which the swivel bar confronts the trigger rear is also a matter of accommodation. For example, the safety device 12 may be mounted with the trigger blocking swivel bar 16 oriented to point downwardly, that is, away from the firing chamber.

Where a magnetically non-attractable handle is employed, a magnetic swivel bar can be directly incorporated into the firearm handle at the time of manufacture, while any non-magnetic material may be used for the handle with a non-magnetic swivel bar. A housing for the swivel bar could be provided, molded integrally with the handle or stock, and the swivel bar pivotally mounted in the housing. The housing would serve as the stop.

In FIG. 8 is depicted the safety device 12 mounted onto the trigger protector 54 of a rifle. In its rest position the swivel bar 16 blocks the movement of the trigger 22 preventing the weapon from being fired. The orientation of the swivel bar 16, which may for example, point either toward or away from the barrel, is a matter of design choice.

In FIG. 9 a further embodiment of the invention is illustrated, herein incorporated in a revolver 60 having trigger 62 and hammer 64 operated by a leaf spring 66. A bar rebound slide 68 within the revolver frame 69 is normally able to slide along a track 70 in response to the movement of the trigger 62. Full movement of the slide typically releases the hammer 64 discharging the revolver 60. The movement of the slide 68 will be inhibited by a peg or bar interposed between a backstop 72 and the slide 68. Thus, full movement of the slide 68 is inhibited, preventing release of the hammer 64, thereby preventing undesired discharge of the firearm.

The safety restrictor 74 may be mounted in a number of ways to magnetically actuable safety device. For example, in FIG. 9, the restrictor 74 is mounted on one end of a swivel bar 76 centrally balanced on a pivot pin 78. The pivot pin 78 is mounted to a wall of a magnetically non-attractable housing 80 such as aluminum. The swivel bar may be mounted in the central vertical plane of the revolver so that the safety restrictor 74 may move across the path of the slide 68. For example, in FIG. 9, the swivel bar 76 is shown mounted to the pin 78 mounted to the front wall of the handle grip housing 80. The housing 80 may be incorporated into the revolver frame 69 and covered by the stock 82 (shown in phantom). In this position the housing 80 forms a portion of the frame 69 adjacent the position where a user would normally place his or her fingers when holding the revolver.

The swivel bar 76 includes a polarized magnet 84 at the end opposite the restrictor 74 and adjacent to a margin of the frame 69. The swivel bar 76 may, for example, comprise a copper jacket having nonferruginous peg forming the restrictor 74 at one end and a permanent magnet 84 at the opposite end. The axis for the swivel bar 76 may be located at or near the center of the poles of the magnet 84.

In a neutral or safety rest position, the swivel arm 76 is biased to block the slide 68 with the restrictor 74. Biasing force is provided by fixed magnetically attractable means 86 positioned to confront and attract the swivel arm magnetic means 84 adjacent the desired neutral pivotal orientation of the end of the swivel bar 76. The fixed magnetic means 86 may be either a permanent magnet attractive of the magnet 84 or a mass of ferruginous material such as steel.

In order to release the safety device, putting the revolver in a condition for firing, the user, wearing an appropriate magnetic ring (not shown) on for example the third finger (not shown) merely grips the handle stock 82 to bring the ring in proximity to the magnet 84 to either side or confronting the central plane of the revolver. The magnetic forces are of sufficient magnitude between the ring and the magnet 84 at one end of the swivel bar 76 causing it to pivotally displace, moving the restrictor 74 at the opposite end from the position normally blocking movement of the slide 68 to a position permitting unrestricted slide and trigger movement.

The relative magnetic polarities of the swivel bar magnet 84 and the confronting ring magnet are preferably selected to repel one another, since it has been found that repelling poles in these configurations create the greatest likelihood that the swivel bar 76 will be adequately displaced, even where the ring exerts nearly perpendicular force.

Figure 10:
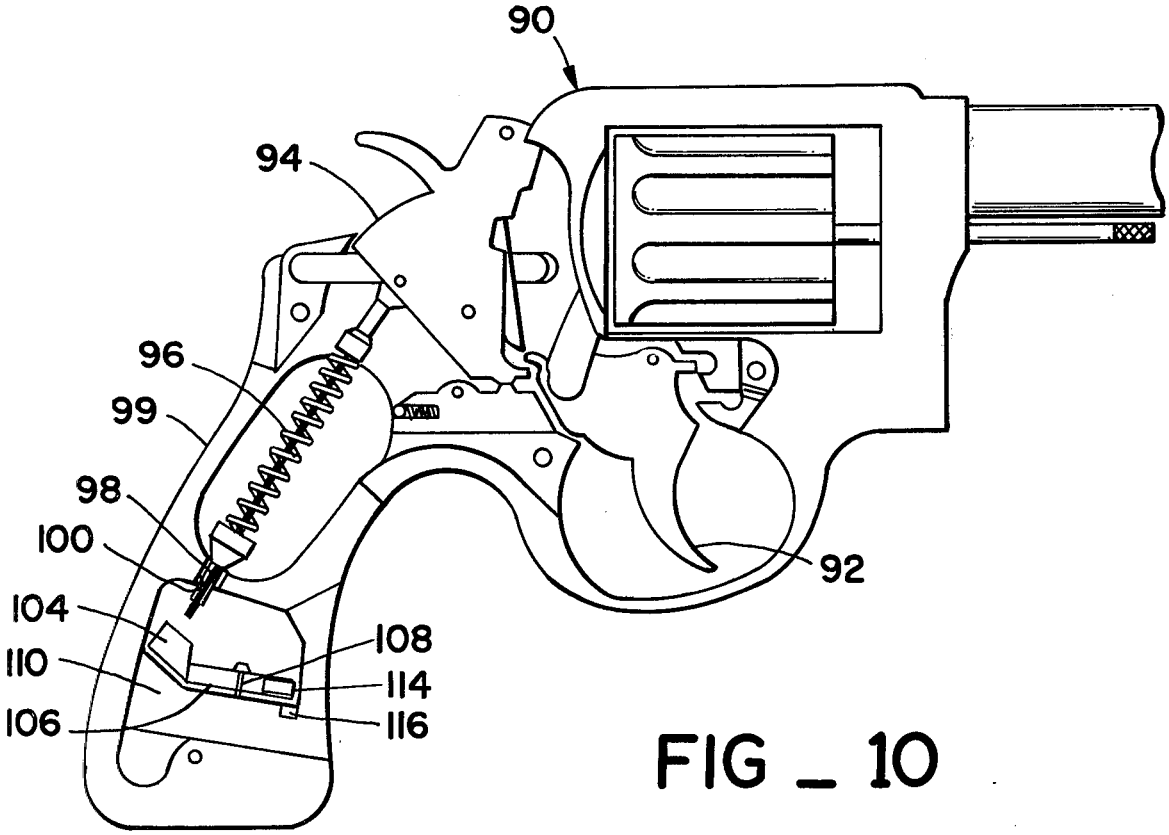
FIG. 10 is a side elevation view of a further embodiment of a revolver incorporating the safety device.

In FIG. 10 the invention is incorporated in a revolver 90 having a trigger 92 and hammer 94 operated by a compression spring 96. A shaft or rod 98 within the revolver handle frame 99 is biased by the spring 96 against the hammer 94 and is slidable in a track 100 directing rod movement approximately along the maximum length of the handle frame 99 in response to hammer rotation. When the restrictor 104 is in the confronting position the hammer 94 cannot be handcocked, and the trigger 92 cannot displace the hammer 94 sufficiently to release the hammer 94 to fire the gun.

A safety restrictor 104 is mounted on one end of a swivel bar 106, which is centrally balanced on a pivot pin 108, and is mounted to a magnetically non-attractable housing 110 incorporated into the handle frame 99. In this embodiment, the pivot pin 108 is mounted in the central vertical plane of tjhe revolver and the swivel bar 106 is oriented to displace perpendicularly side to side across the path of the rod 98. On the end of the swivel bar 106 opposite the restrictor 104 and adjacent an edge of the frame 99, a permanent polarized magnet 114 may be attached. A bias magnet 116 or magnetically attractable material may be fixedly mounted to or in the housing 110 in a position to attract the swivel bar magnet 114 so that the swivel arm 106 holds the restrictor 104 in a position blocking the shaft or rod 98. For example, the bias magnet 116 may be mounted directly below the neutral position of the swivel bar magnet 114. Alternatively a hairspring or the like may be employed to maintain the restrictor 104 in a blocking position.

In operation, the restrictor 104 is normally biased to a position blocking the translation of the rod 98 coupled to the hammer 94, thereby preventing the hammer from maximum rotational movement and spring release. Thus, the hammer can neither be hand-cocked for single action firing nor trigger-released as in double action firing. To release the safety device and allow the hammer to release and discharge the firearm, a magnetic ring is typically worn on the ring finger of the user gripping the firearm handle to bring it into proximity with the magnetic end of the swivel bar 106 nearest the front side of the handle. The magnetic forces, preferably repulsion between the magnetic ring and the magnet 114, cause the swivel bar to rotate, unblocking the free movement of the rod 98. The trigger may then be fully retracted, or the hammer may be cocked, so the firearm can be discharged. Thus, the term "discharge movement" as used herein means any movement of the hammer, whether forward or backwards, for the purpose of firing the weapon.

The safety device has been employed with a Smith & Wesson Automatic Model 59, a Smith & Wesson Revolver Model 10, which utilizes a leaf spring (FIG. 9) or a Smith & Wesson Revolver 36, which utilizes a coil or compression spring. In the automatic, the safety device was quite small with its largest dimension a fraction of an inch. The housing may be from about 0.2 to 0.4 inch in width and about 0.3 to 0.6 inch in length with the bar about 0.4 to 0.6 inch in length, and the swivel bar extending from about 0.2 to 0.4 inch from the housing. The bar should be of a strong material, but relatively light and be pivotally mounted with a minimum of drag. The bar can be as little as about 25 mils in thickness, although somewhat greater thicknesses are preferred. In the Model 10 and the Model 36, the safety device is conveniently incorporated into the handle.

The magnetic safety device may also be configured to prevent the release of a cocked hammer to strike a firing pin, or to prevent the release of a cocked hammer which would discharge the firearm. For example a rod may be interposed between the firing pin and the hammer on those weapons having a firing pin separate from the hammer while the safety device is in a neutral or safety "on" condition. Alternatively, on those weapons where the firing pin is incorporated on or in combination with the hammer, the rod may be interposed between the hammer and the cartridge in the firing chamber of the weapon. This has the advantage of preventing discharge of a cocked firearm, without the magnetic ring, even though trigger actuation is not blocked. This is particularly useful in firearms designed for single action firing, where the hammer may be cocked independent of the trigger.

The subject invention provides a simple device which acts as a safety feature in the use of firearms. It is particularly useful to prevent unauthorized or accidental discharge of the firearm. This includes children and accidents, such as having a shotgun fall from being propped against a tree. Law enforcement officers, who carry weapons normally loaded, are protected from having the weapon taken from them and fired at them by employing the subject device. Also, accidental firing is inhibited, since the hammer actuation means is inhibited from operating by the safety device of the present invention. Other advantages with law enforcement officers is the elimination of setting the safety catch, since the pistol is normally carried loaded. The subject invention also eliminates the time required to remove the safety, so that the officer may act more rapidly.

Although the foregoing invention has been described in some detail by way of illustration and example for purposes of clarity of understanding, it will be obvious that certain changes and modifications may be practiced within the scope of the appended claims.

What is claimed is:

1. A safety device for preventing unauthorized firing of a weapon having a trigger, a hammer, and a hammer actuation means, comprising:

a magnetically actuable member pivotally mounted with respect to said hammer actuation means, said member having at least one magnetically polarized end;

stop means for preventing said member from pivoting beyond a predetermined arc;

bias means for maintaining said member in a position of the arc for preventing the actuation of said hammer actuation means firing said weapon;

means responsive to the position of said magnetically actuable member for blocking operation of said hammer actuation means; and, a magnetic ring for wearing on a finger of a hand gripping said weapon, said ring being operative to repel said polarized end when said ring is being worn on a finger of the weapon-gripping hand.

2. A safety device for preventing unauthorized firing of a weapon having a trigger, a hammer, and a hammer actuation means, comprising:

a magnetically actuable member pivotally mounted with respect to said hammer actuation means, said member having at least one magnetically polarized end;

stop means for preventing said member from pivoting beyond a predetermined arc;

bias means for maintaining said member in a position of the arc for preventing the actuation of said hammer actuation means firing said weapon;

means responsive to the position of said magnetically actuable member for blocking operation of said hammer actuation means; and, a magnetic ring for wearing on a finger of a hand gripping said weapon, said ring being operative to attract said polarized end when said ring is being worn on a finger of the weapon-gripping hand.

3. A safety device for preventing the unauthorized firing of a weapon having a trigger, a hammer, and a hammer actuation means, comprising:

a magnetically actuable member pivotally mounted with respect to said hammer actuation means;

stop means for preventing said member from pivoting beyond a predetermined arc; and bias means for maintaining said member in a position of the arc for blocking the discharge movement of said hammer.

4. A safety device for preventing unauthorized firing of a weapon having a trigger, a hammer, and hammer actuation means, comprising:

a magnetically actuable member pivotally mounted with respect to said hammer actuation means, said hammer actuation means including a slide coupled to said trigger;

stop means for preventing said member from pivoting beyond a predetermined arc; and bias means for maintaining said member in a position of the arc for presenting a first end of said member in a blocking relationship with said slide preventing the actuation of said hammer actuation means firing said weapon.

5. A safety device according to claim 4, wherein said device is mountable within a frame of said weapon and wherein said magnetically actuable member is operative to pivotally displace in response to magnetic repulsion applied adjacent a magnetically polarized second end of said member.

6. A safety device according to claim 4, wherein said device is mountable within a frame of said weapon, and wherein said magnetically actuable member is operative to pivotally displace in response to a magnetic attraction applied adjacent a magnetically attractable second end of said member.

7. A safety device for preventing unauthorized firing of a weapon having a frame, a trigger, a hammer, and hammer actuation means comprising:

a magnetically actuable member pivotally mounted with respect to said hammer actuation means, said hammer actuation means including a rigid member pivotally coupled to said hammer within the frame of said weapon;

stop means for preventing said magnetically actuable member from pivoting beyond a predetermined arc; and bias means for maintaining said magnetically actuable member in a position of the arc for blocking movement of said rigid member preventing the actuation of said hammer actuation means firing said weapon.

8. A safety device as in claim 7 wherein said magnetically actuable member comprises a bar having a first end disposed in blocking relationship with said rigid member and having a magnetically polarized second end adjacent an outer wall of said frame.

9. A safety device according to claim 8, wherein said bar is operative to pivotally displace in response to magnetic repulsion applied in proximity to said second end.

10. A safety device according to claim 8 wherein said magnetically actuable member is operative to pivotally displace in reponse to magnetic attraction applied in proximity to said second end.

11. A safety device for preventing unauthorized firing of a weapon having a trigger, a hammer, and hammer actuation means comprising:

a magnetically actuable member pivotally mounted with respect to said hammer actuation means, said member having a first end disposed for preventing actuation of said hammer actuation means and a magnetically polarized second end;

stop means for preventing said member from pivoting beyond a predetermined arc;

bias means for maintaining said member in a position of the arc for preventing the actuation of said hammer actuation means firing said weapon; and a magnetic ring for wearing on a finger of a hand gripping said weapon, said ring being operative to repel said second end when said ring is being worn on a finger of the weapon-gripping hand.

12. A safety device for preventing unauthorized firing of a weapon having a trigger, a hammer, and hammer actuation means comprising:

a magnetically actuable member pivotally mounted with respect to said hammer actuation means, said member further comprising a restrictor responsive to the position of said member;

stop means for preventing said member from pivoting beyond a predetermined arc; and bias means for maintaining said restrictor in a position of the arc for blocking discharge movement of said hammer such that firing of said weapon is prevented.

13. A safety device for preventing unauthorized firing of a weapon having a trigger, a hammer, and hammer actuation means comprising:

a magnetically actuable member pivotally mounted with respect to said hammer actuation means, said member having a first end disposed for preventing actuation of said hammer actuation means and a magnetically polarized second end;

stop means for preventing said member from pivoting beyond a predetermined arc;

bias means for maintaining said member in a position of the arc for preventing the actuation of said hammer actuation means firing said weapon; and a magnetic ring for wearing on a finger of a hand gripping said weapon, said ring being operative to attract said second end when said ring is being worn on a finger of the weapon-gripping hand.

* * * * *